US006530135B1

(12) United States Patent
Soleymani

(10) Patent No.: US 6,530,135 B1
(45) Date of Patent: Mar. 11, 2003

(54) CAMSTOPPER

(76) Inventor: Bahram Soleymani, 618 S. Sycamore, Apt. #8, Lansing, MI (US) 48933

( * ) Notice: Subject to any disclaimer, the term of this patent is extended or adjusted under 35 U.S.C. 154(b) by 0 days.

(21) Appl. No.: 09/714,347

(22) Filed: Nov. 15, 2000

(51) Int. Cl.[7] ..... B25B 27/14

(52) U.S. Cl. ..... 29/281.5; 29/888.011; 29/271; 29/276; 29/199; 29/229; 29/402.03; 411/366

(58) Field of Search ..... 29/888.011, 402.03, 29/402.08, 426.1, 464, 559, 281.1, 281.5, 281.6, 283; 411/366

(56) References Cited

U.S. PATENT DOCUMENTS

| | | | | | |
|---|---|---|---|---|---|
| 4,223,585 | A | | 9/1980 | Barth et al. | |
| 4,304,503 | A | | 12/1981 | Gehring et al. | |
| 4,729,707 | A | | 3/1988 | Takahashi | |
| 4,930,962 | A | | 6/1990 | Reynolds | |
| 5,071,301 | A | | 12/1991 | Engelhardt et al. | |
| 5,247,737 | A | * | 9/1993 | Perry | 29/888.01 |
| 5,425,168 | A | * | 6/1995 | Bumbaco | 29/720 |
| 5,474,408 | A | | 12/1995 | Dinitz et al. | |
| 5,502,982 | A | | 4/1996 | Venetucci | |
| 5,685,060 | A | * | 11/1997 | Tibbet | 29/559 |
| 5,755,029 | A | | 5/1998 | Learned | |
| 5,769,583 | A | | 6/1998 | Girbinger | |
| 5,950,294 | A | | 9/1999 | Gibbs | |
| 6,058,585 | A | | 5/2000 | Soleymani | |
| 6,311,395 | B1 | * | 11/2001 | Wieres | 29/890 |

OTHER PUBLICATIONS

Flywheel Lock; Sir Tool 215, May 9, 2002 (date downloaded from internet, could not find date posted), pp. 1–2.*

"Timing Belts Domestic and Import Cars, Light Trucks and Vans 1974–1998, 1999 Ed."; Feb. 1999; pp. 104–107; Autodata Publications Inc., Hudson, MA. USA.

* cited by examiner

*Primary Examiner*—Joseph J. Hail, III
*Assistant Examiner*—Daniel Shanley
(74) *Attorney, Agent, or Firm*—Irell & Manella, LLP

(57) ABSTRACT

The present invention comprises a camshaft holding tool and corresponding method for operating the camshaft holding tool in double overhead camshaft engines. In one embodiment, the holding tool includes a body portion including first and second curved portions, where each of the first and second curved portions includes two or more teeth. Each tooth of the first and second curved portions engages adjacent teeth of respective one of first and second camshaft sprockets. A method of operating the tool includes placing the tool between the first and second camshaft sprockets and rotating the tool about an axis until the teeth of the first and second curved portions engage teeth of the first and second camshaft sprockets, respectively.

19 Claims, 5 Drawing Sheets

CAMSTOPPER

BACKGROUND OF THE INVENTION

1. Field of the Invention

The present invention relates generally to the field of tools for use with internal combustion engines, and specifically, to a tool and method of use thereof for double over head cam internal combustion engines.

2. Background Information

Replacing a timing belt on dual overhead camshafts internal combustion engines is not an easy task. This is because the camshaft sprockets must be in fixed relation to each other when the timing belt is installed. However, when the timing belt is removed from the camshaft sprockets, the camshaft sprockets rotate due to the pressure induced by valve springs. If the camshaft sprockets are not in fixed relation to each other when the timing belt is installed, the engine will show undesirable symptoms such as engine misfire, hasty acceleration, idle problems, high emissions, and, in some extreme cases, internal engine or valve train damage. This problem is even worse in V6 V8 dual overhead camshaft engines. Typically, the installation of the timing belt requires two people, one person to hold the camshaft sprockets in relation to each other and a second person to install the timing belt.

Accordingly, there is a need for a more efficient apparatus and method for changing and/or installing timing belts for dual overhead cam internal combustion engines.

SUMMARY OF THE INVENTION

The present invention comprises a camshaft holding tool and corresponding method for operating the camshaft holding tool in double overhead camshaft engines. In one embodiment, the holding tool includes a body portion including first and second curved portions, where each of the first and second curved portions including two or more teeth. Each tooth of the first and second curved portions engages adjacent teeth of respective one of first and second camshaft sprockets.

Other embodiments are claimed and described herein.

DETAILED DESCRIPTION

The present invention comprises a camshaft holding tool and method for operating the camshaft holding tool in double overhead camshaft engines. In one embodiment, the holding tool includes a body portion including first and second curved portions, where each of the first and second curved portions including two or more teeth. Each tooth of the first and second curved portions engages adjacent teeth of respective one of first and second camshaft sprockets. The camshaft holding tool 10 is directed at holding the camshaft sprockets in fixed relation to each other (e.g., top dead center) in a dual overhead camshaft internal combustion engine when a timing belt is removed.

Figure 1:
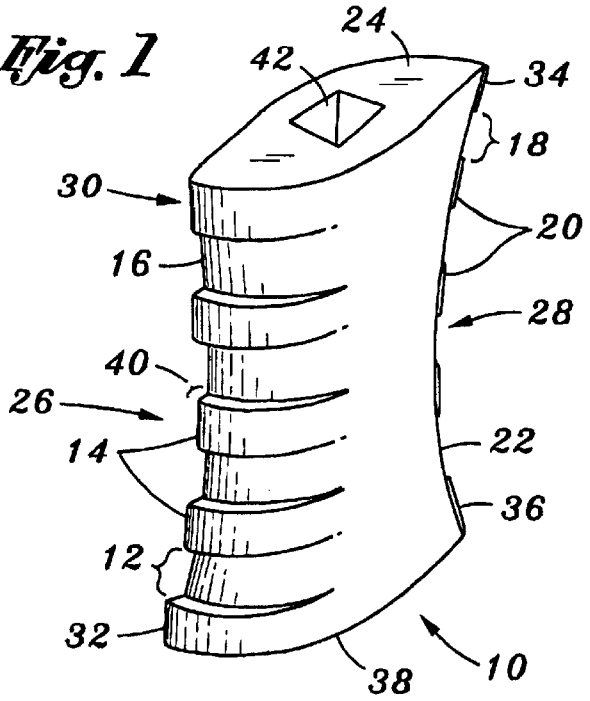
FIG. 1 shows a perspective view of a camshaft engagement tool for use with a dual overhead camshaft engine, according to one embodiment of the present invention.

FIG. 1 shows a perspective view of a camshaft engagement tool 10 for use with a dual overhead camshaft engine, according to one embodiment of the present invention. The camshaft engagement tool 10 is a single piece structure that is made from one or more metals (e.g., aluminum), hard plastic, or other material such as Delrene, ABS-glass fill, etc. The tool 10 may be created using an injection molding process.

Referring to FIG. 1, the camshaft engagement tool 10 includes opposite concave sides 26 and 28. The first concave side 26 is contoured 16 from a first end 30 to a second end 32, and includes a plurality of teeth (or cogs) 14 spaced apart from each other by a first distance 12. Correspondingly, the second concave side 28 is contoured 22 from a first end 34 to a second end 36, and includes a plurality of teeth 20 spaced apart from each other by a second distance 18. The first and second concave sides 26 and 28 of the camshaft engagement tool 10 are complementary with first and second camshaft sprockets (or cog wheels) of a dual overhead camshaft engine such that each tooth of the first and second concave sides 26 and 28 engages adjacent teeth of a respective one of the camshaft sprockets (see, e.g., FIG. 5).

In one embodiment, each concave side 26 and 28 includes at least two teeth, and may include three, four, five, or more teeth. Moreover, in one embodiment, the teeth on one concave side are symmetrically placed with the teeth of the other concave side, as shown in FIG. 1. However, the teeth on one concave side may be asymmetrical with teeth of the other concave side.

The camshaft engagement tool 10 further includes a top portion 24 and a bottom portion 38. The top portion 24 defines a cavity 42 which may be square or other shape to allow the tool 10 to be engaged using a ratchet, screw driver, extension, or other tool. The bottom portion 38 may similarly define a cavity for the same purpose. It is to be noted that the engagement tool 10 may be engaged using one's hand.

The dimensions of the camshaft engagement tool 10 include, but are not limited to, the height, length, and width of the tool, the amount of curvature of each contour, the number of teeth, the spacing between teeth, and the depth of each tooth (referred to as numeral 40), etc. The dimensions of the camshaft engagement tool 10 may vary without departing from the spirit and scope of the present invention. For example, the dimensions may vary depending on the size of the camshaft sprockets, the spacing between adjacent cogs, the distance between the camshaft sprockets, and the like.

Figure 2B:
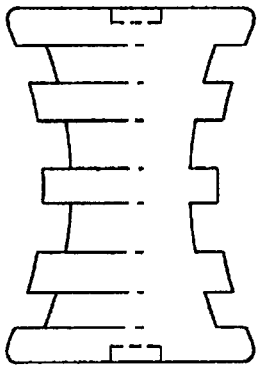
FIGS. 2A through 2C show side views and a top view of the camshaft engagement tool, according to one or more embodiments of the present invention.
Figure 2C:
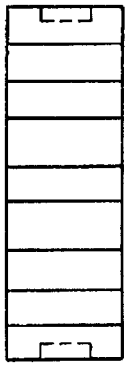
Figure 2A:
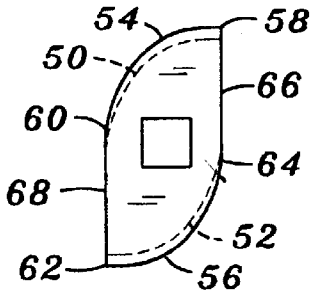

FIG. 2A illustrates a top view of the camshaft engagement tool 10 of FIG. 1. FIG. 2B illustrates a first side view of the camshaft engagement tool 10 of FIG. 1. FIG. 2C illustrates a second side view of the camshaft engagement tool 10 of FIG. 1.

Referring to FIG. 2A, the dashed lines 50 and 52 represent the contours of the first and second concave portions. The solid lines 54 and 56 represent the teeth of the first and second curved portions. The distance between dashed line 50 and solid line 54, and the distance between dashed line 52 and solid line 56 represent the depth of the teeth (e.g., as shown by numeral 40 in FIG. 2). Such distances may vary as a tooth is traversed from one end (numeral 58 or numeral 62) to the other (numeral 60 or numeral 64). In this embodiment, the camshaft engagement tool 10 includes substantially flat sides 66 and 68. In one embodiment, the flat sides 66 and 68 provide stability for engagement of the tool 10 and prevent the tool from being over-rotated (see, e.g., FIG. 5). In another embodiment, the sides 66 and 68 may be curved such that teeth of one curved portion extend up to or just short of the teeth of the other curved portion.

Figure 3:
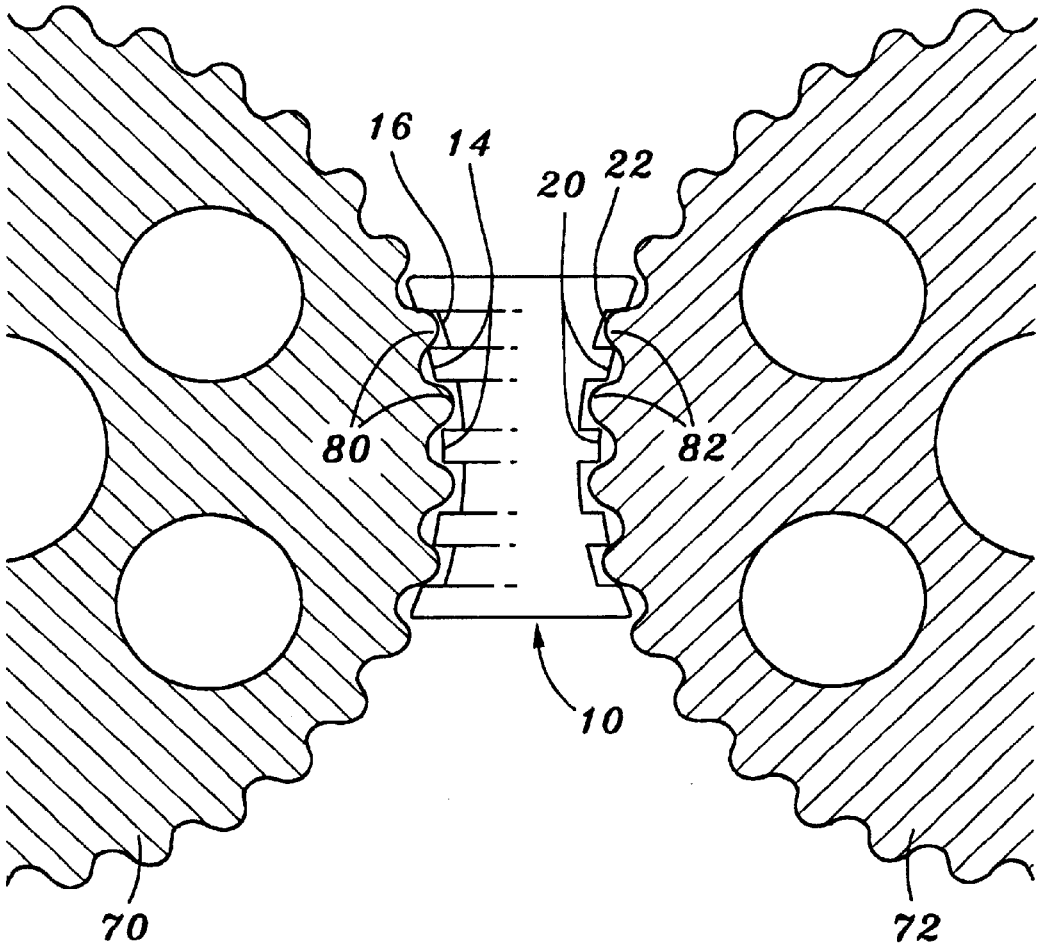
FIG. 3 shows a side view of the camshaft engagement tool engaging camshaft sprockets, according to one embodiment of the present invention.

FIG. 3 illustrates a side view of the camshaft holding tool 10 engaging camshaft sprockets 70 and 72 of a dual overhead cam engine. As shown in FIG. 3, the tool 10 is engaged such that each tooth 14 on contour 16 engages adjacent cogs 80 of the camshaft sprocket 70 and each tooth 20 on contour 22 engages adjacent cogs 82 of the camshaft sprocket 72. In this position, the camshaft holding tool 10 prevents the camshaft sprockets 70 and 72 from rotating and holds the sprockets in fixed relation to each other (e.g., top dead center, as is known in the art).

Figure 4:
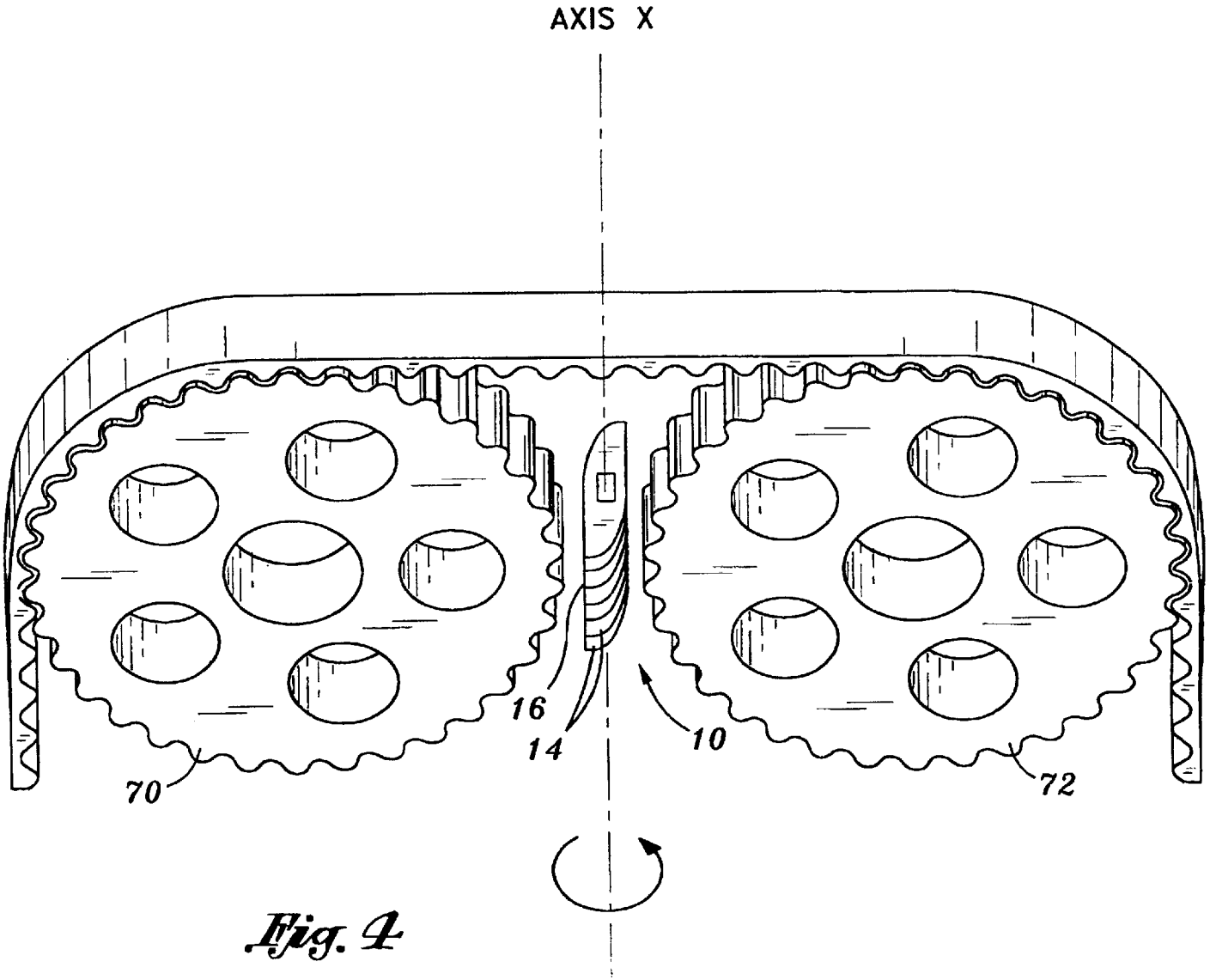
FIG. 4 shows a perspective view of the camshaft engagement tool placed between camshaft sprockets of a dual overhead camshaft engine prior to engagement, according to one embodiment of the present invention.

FIG. 4 shows a perspective view of the camshaft engagement tool 10 placed between camshaft sprockets of a dual overhead camshaft engine prior to engagement, according to one embodiment of the present invention.

Figure 5:
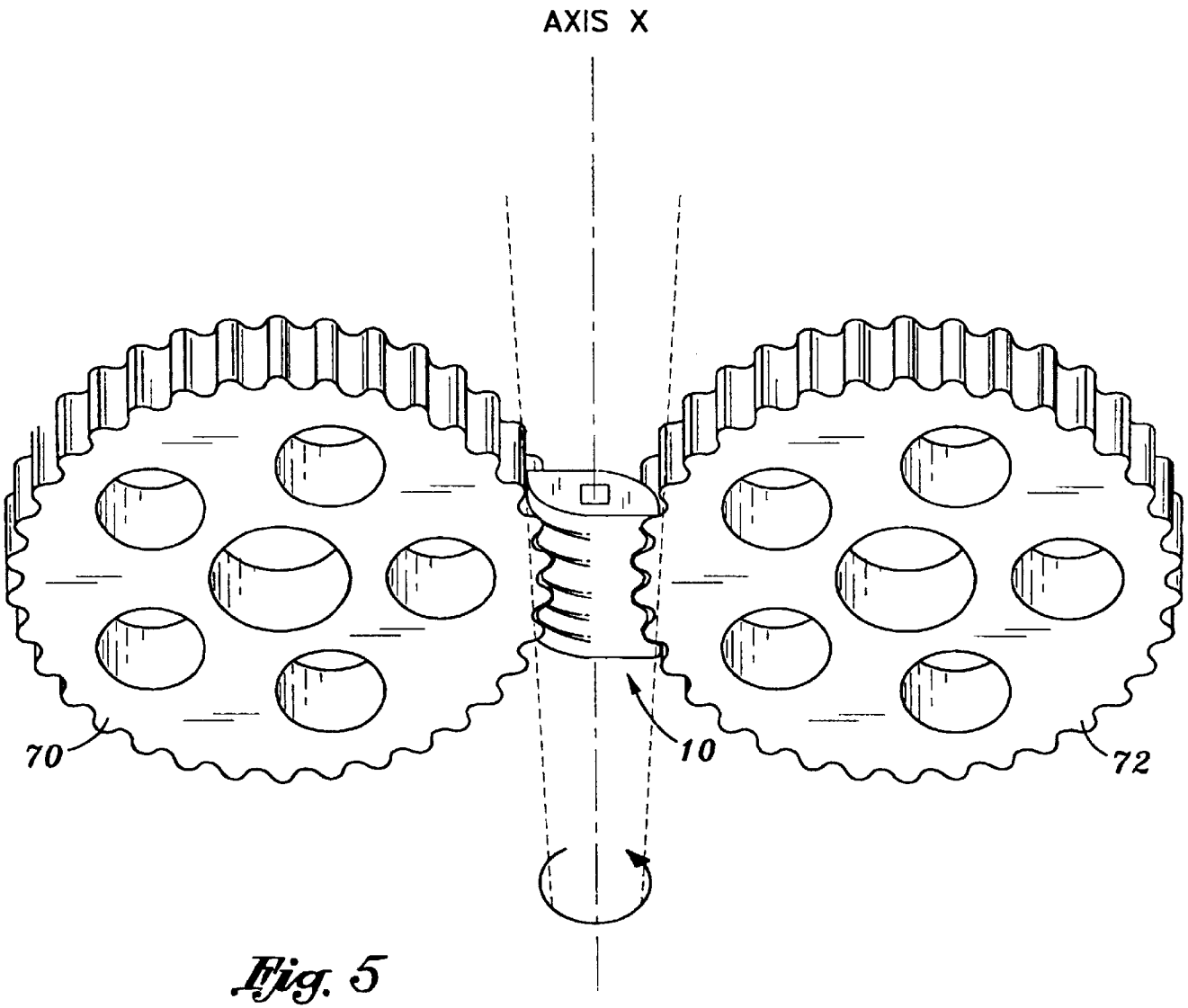
FIG. 5 shows a perspective view of the camshaft engagement tool placed between camshaft sprockets of a dual overhead camshaft engine after engagement, according to one embodiment of the present invention.
Figure 6:
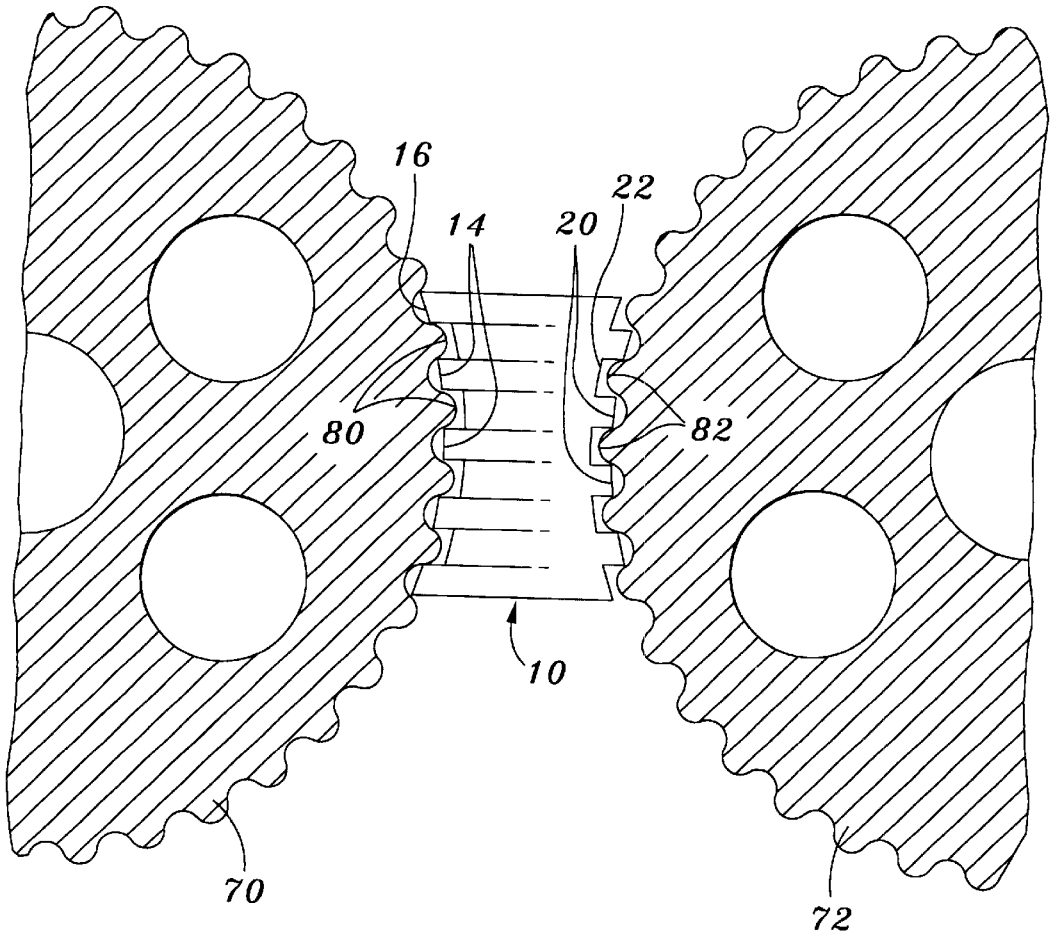
FIG. 6 shows a side view of the camshaft engagement tool engaging camshaft sprockets, according to another embodiment.

A method of engaging camshaft sprockets 70 and 72 in order to remove a timing belt will now be described. Optionally, the camshaft sprockets 70 and 72 may be oriented in a desired position with respect to each other (e.g., top dead center). The camshaft holding tool 10 is positioned between camshaft sprockets 70 and 72, as shown. The tool 10 is then rotated counter clock-wise with respect to the X-axis until the teeth of first and second curved portions engage respective teeth of the camshaft sprockets, as shown in FIG. 5. In one embodiment, the tool 10 is rotated approximately 90 degrees (e.g., +/−30 degrees) counter-clockwise. However, the tool 10 may be rotated any amount of degrees (e.g., 25 degrees, 45 degrees, 120 degrees, etc.) so long as the tool 10 snuggly engages the camshaft sprockets 70 and 72. The timing belt may then be removed, as the camshaft holding tool 10 holds the camshaft sprockets 70 and 72 in place. Once the timing belt (or a new timing belt) is placed back on the camshaft sprockets 70 and 72, the tool is rotated in an opposite direction (e.g., clock-wise) in order to disengage the tool from the camshaft sprockets 70 and 72, respectively.

In another embodiment, where the curved portions are symmetrical such that the teeth of the curved portions coincide on both ends of the tool, the tool may be rotated in either the clock-wise or counter clock-wise direction to engage the camshaft sprockets.

As can be seen, the present invention describes a camshaft holding tool that is used for holding camshaft sprockets of a dual overhead camshaft engine in place while the timing belt is removed. The tool is a single piece that is easy to manufacture. Additionally, the tool is very easy to use, making a mechanics job much easier in changing the timing belt or performing other repairs that require the timing belt to be removed. In the case of V6, V8, and V12 engines, two camshaft holding tools are used, one for each cylinder bank.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A double overhead camshaft engagement tool, comprising:

An integrated body portion including first and second curved portions, each of the first and second curved portions including two or more teeth such that, when the integrated body portion is positioned between first and second camshaft sprockets and rotated, each tooth of the first and second curved portions engages adjacent teeth of a respective one of the first and second camshaft sprockets to hold the first and second camshaft sprockets in place when a timing belt is removed, said integrated body portion further including a top portion defining a cavity, said cavity to receive a separate tool for rotating the integrated body portion to engage the first and second camshaft sprockets.

2. The double overhead camshaft engagement tool of claim 1 wherein the body portion further comprises first and second flat sides adjacent the first and second curved portions to prevent the tool from being over-rotated.

3. The double overhead camshaft engagement tool of claim 1 wherein the integrated body portion is made from one or more of the following: metal and plastic.

4. The double overhead camshaft engagement tool of claim 1 wherein the first and second curved portions of the integrated body portion are substantially complementary with the first and second camshaft sprockets, respectively.

5. The double overhead camshaft engagement tool of claim 1 wherein the teeth of the first curved portion are aligned with the teeth of the second curved portion.

6. The double overhead camshaft engagement tool of claim 1 wherein the teeth of the first curved portion are not aligned with the teeth of the second curved portion.

7. The double overhead camshaft engagement tool of claim 1 wherein the body portion includes a top portion and a bottom portion, where one or both of the top and bottom portions each defines a cavity to receive a tool for engaging and disengaging the body portion.

8. A tool for use with a double overhead camshaft engine, comprising:

an integrated structure defining a length, a width that is smaller than the length, and a height, said integrated structure including first and second concave portions, generally along the length of the integrated structure, complementary with first and second camshaft sprockets, respectively, of an internal combustion engine, said first and second concave portions each including a plurality of teeth for engaging teeth of the respective first and second camshaft sprockets, the width of the integrated structure being smaller than a shortest distance between the first and second camshaft sprockets, said integrated structure further including at least one of a top and bottom portion, said at least one of the top and bottom portion defining a cavity, said cavity to allow rotation of the integrated structure for engagement and disengagement of the first and second camshaft sprockets.

9. The tool of claim 8 wherein when the integrated structure is positioned between the first and second camshaft sprockets and rotated, each tooth of the first and second concave portions engages adjacent teeth of the respective one of the first and second camshaft sprockets.

10. The tool of claim 8 wherein said unitary structure further including at least one of a top and bottom portion, said at least one of the top and bottom portion defining cavity, said cavity to receive a separate tool for rotating the unitary structure to engage and disengage the first and second camshaft sprockets.

11. The tool of claim 8 wherein the integrated structure is made from one or more of the following: metal and plastic.

12. The tool of claim 8 wherein the teeth of the first concave portion are asymmetrical with the teeth of the second concave portion.

13. The tool of claim 8 wherein the integrated structure further comprises first and second flat sides adjacent the first and second concave portions.

14. The tool of claim 8 wherein the integrated structure is made from at least one of Delrene and ABS-glass fill.

15. A tool for use with a double overhead camshaft engine, comprising:

an integrated structure including first and second concave portions, said first and second concave portions respectively shaped to accommodate first and second camshaft sprockets of an internal combustion engine, each of said first and second concave portions including a plurality of teeth, each tooth of the first and second concave portions for engaging adjacent teeth of the respective first and second camshaft sprockets, said integrated structure further including at least one of a top and bottom portion defining a cavity, said cavity to allow rotation of the integrated structure for engagement of the first and second camshaft sprockets.

16. The tool of claim 15 wherein when the integrated structure is positioned between the first and second camshaft sprockets and rotated, each tooth of the first and second concave portions engages adjacent teeth of the respective one of the first and second camshaft sprockets.

17. The tool of claim 15 wherein the integrated structure is made from one or more of the following: metal and plastic.

18. The tool of claim 15 wherein the teeth of the first concave portion are asymmetrical with the teeth of the second concave portion.

19. The tool of claim 15 wherein the integrated structure further comprises first and second flat sides adjacent the first and second concave portions.

* * * * *